United States Patent [19]

Douglass

[11] Patent Number: 4,606,579

[45] Date of Patent: Aug. 19, 1986

[54] REMOVABLE ARM FOR WHEELCHAIRS

[75] Inventor: John Douglass, Creve Coeur, Mo.

[73] Assignee: Smith & Davis Manufacturing Company, St. Louis, Mo.

[21] Appl. No.: 546,975

[22] Filed: Oct. 31, 1983

[51] Int. Cl.[4] ..... A47C 7/54

[52] U.S. Cl. ..... 297/416; 297/DIG. 4

[58] Field of Search ..... 297/416, 45, 417, DIG. 4, 297/411, 414; 403/13, 14

[56] References Cited

U.S. PATENT DOCUMENTS

| | | | |
|---|---|---|---|
| 383,169 | 5/1888 | Buckman | 297/416 |
| 2,354,949 | 8/1944 | Ducavich | 297/DIG. 4 |
| 2,402,085 | 6/1946 | Rideout | 297/DIG. 4 |
| 2,716,441 | 8/1955 | Jennings | 297/DIG. 4 |
| 3,140,119 | 7/1964 | Offner | 297/DIG. 4 |
| 3,198,575 | 8/1965 | Hawkins | 297/416 |
| 3,244,453 | 4/1966 | Fox | 297/DIG. 4 |
| 4,082,348 | 4/1978 | Haury | 297/DIG. 4 |
| 4,140,341 | 2/1979 | Rabe | 297/DIG. 4 |
| 4,358,125 | 11/1982 | Charles | 297/DIG. 4 |

FOREIGN PATENT DOCUMENTS

| | | | |
|---|---|---|---|
| 2047528 | 12/1980 | United Kingdom | 297/416 |
| 2058683 | 4/1981 | United Kingdom | 297/416 |
| 2077846 | 12/1981 | United Kingdom | 403/13 |

*Primary Examiner*—Francis K. Zugel
*Assistant Examiner*—Mark W. Binder
*Attorney, Agent, or Firm*—Gravely, Lieder & Woodruff

[57] ABSTRACT

A wheelchair arrangement in which the side frames which are supported by the wheels are provided with sockets for the reception of arm assemblies having elements formed to be inserted in the side frame sockets for easy removal. In that arrangement, the sockets are held in spaced relation at a fixed dimension, the sockets are formed so that one socket has a major dimension greater than any dimension of the other socket, and the elements on the arm assemblies are spaced apart and sized to fit into the sockets to be substantially free of sideways wobble, with one socket having its major dimension oriented to allow reception of one element and accommodate tolerances in the spacing of the elements on the arm assemblies.

4 Claims, 3 Drawing Figures

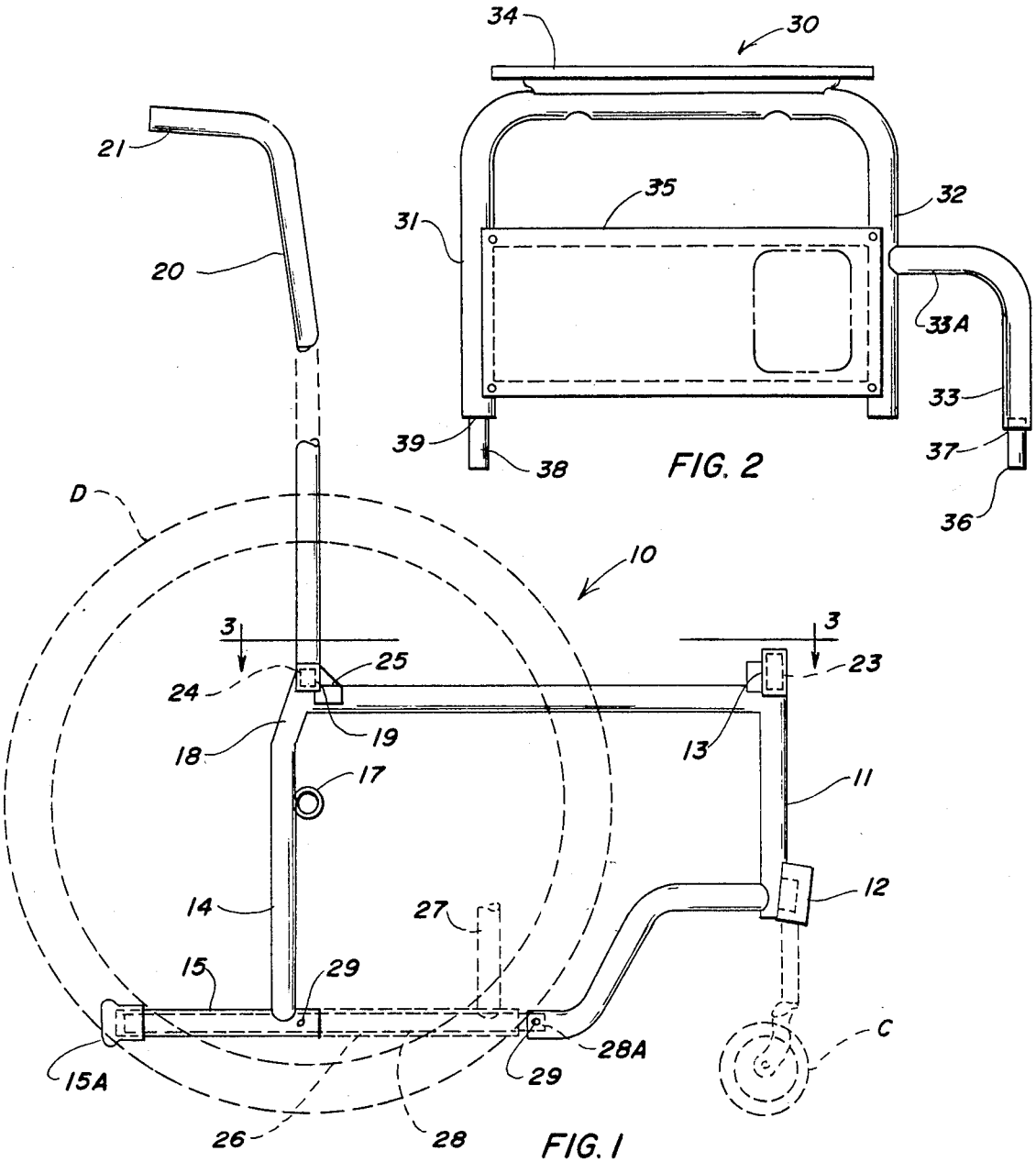
FIG. 2
FIG. 1
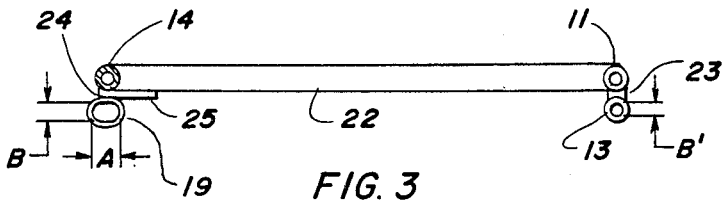
FIG. 3

REMOVABLE ARM FOR WHEELCHAIRS

BACKGROUND OF THE INVENTION

1. Field of the Invention

The present invention pertains to improvements in wheelchairs and especially to wheelchairs in which there are removable arms capable of being easily removed by the occupant.

2. Description of the Prior Art

The construction of wheelchairs has not undergone significant changes for some time, and people who find it necessary to use a wheelchair have simply gone along with the prevailing construction and accepted whatever was available. A particularly troublesome feature in a wheelchair is the difficulty encountered in removing the arm. There are problems due to conflicting requirements for a removable arm that can be inserted in operative positions easily and one that will fit any identical model wheelchair without alteration, without having losseness or play in a side direction. It is known that the arm should be substantially free from sideward motion and be secure enough to allow a patient to apply the full weight on the arm when making a transfer. It has been the prevailing practice to design the internal dimension of the arm receiving socket and the outside dimension of the arm insert tubes to very close tolerances in order to avoid sideward give or wobble. In order to accomplish the close tolerance between socket and insert tubes it is necessary to hold the centerline dimension between sockets on the chair frame and the centerline distance between arm insert tubes to an almost perfect match. This is a difficult thing to achieve and to obtain interchangeability of arms between different chairs. A further difficulty is that if the perfect fit is achieved it requires the arm insert tubes to be inserted evenly in the sockets so that there is no jam in either socket due to tilting of the arm so the insert tubes and sockets are out of line. The several requirements in the fit of an arm to a wheelchair side frame make it very difficult to reach an accuracy greater than present manufacturing techniques can guarantee.

One example of removable arms for wheelchairs is exemplificed by Offner U.S. Pat. No. 3,140,119 of July 7, 1964 where the arm insert tubes have polygonal feet to be received in round sockets. Another example is Fox U.S. Pat. No. 3,244,453 of Apr. 5, 1966 which shows the provision of round stems on the arm insert members received in round sockets. Yet another example is seen in Kernes U.S. Pat No. 3,376,065 of Apr. 2, 1968 where a single square insert and square socket are adapted to locate an arm and prevent arm rotation.

BRIEF SUMMARY OF THE INVENTION

The present invention is concerned with overcoming the problems of making removable arm rests for wheelchairs so that it will no longer be necessary to be so accurate in spacing the sockets and arm frame tube insert ends in order to provide a sturdy and rigid arm rest.

It is an important object of the present invention to be able to overcome the need for requiring manufacturing accuracy in arm rest insert tubes and sockets so that easy insertion of an arm into its sockets can be achieved without losing sideward rigidity.

The improvement in the present invention resides in providing a pair of sockets in which one thereof is elongated or noncircular so that its major dimension is oriented to align in a plane aligned with the center of the cooperating socket. This arrangement eliminates the need for extreme accuracy of distance between arm insert tubes and distance between sockets. It allows being able to apply a close tolerance fit with the noncircular socket so that sideward movement is avoided. At the same time that allows the person using the wheelchair to put full weight on the arm during transfer from the wheelchair. The provision of the elongated or noncircular socket insures a fit of the arm into the sockets even if centerline distances of arm and sockets overlap without sacrificing the close tolerance fit in the sideward direction. And importantly, due to allowance for centerline distances overlap, arms do not have to be fitted for each specific chair model so that a universal fit allows interchange of various style arms on the same model wheelchairs.

BRIEF DESCRIPTION OF THE DRAWINGS

The presently preferred embodiment of the invention is illustrated in the accompanying drawings, wherein:

FIG. 1 is a partial view in side elevation of a wheelchair side frame provided with a removable arm constructed in accordance with the principles of this invention;

FIG. 2 is a view of the arm assembly; and

FIG. 3 is an enlarged and fragmentary view taken along line 3—3 in FIG. 1 to illustrate the dimensional characteristics of the sockets for the removable arm of FIG. 2.

DETAILED DESCRIPTION OF THE EMBODIMENT

Referring now to the detailed description of the embodiment, attention is directed to FIG. 1 of the drawings which illustrates a typical side frame assembly for a wheelchair, such assembly representing one of a pair thereof for a complete wheelchair. The difference between side frame assemblies is that they are made in right and left pairs for the reason that the removable arm assemblies to be referred to presently, are operably mounted on the outside of the side frame assembly. It is not believed necessary to illustrate a complete wheelchair as in the drawing of FIG. 1 there is shown in dotted outline the drive wheel D and a caster wheel C.

In more detail the side frame assembly 10 is made up of tubular components which include a front post 11 having a substantially circular socket 12 for a caster post at its lower end and a front socket 13 at the upper end thereof to receive a forward element of the removable arm assembly to be referred to presently. The assembly also includes a rear post 14 having at its lower end a tubular member 15 which is spaced from a caster arch member 16 attached to the lower end of the front post 11. Part way up from the bottom of the rear post 14 there is a sleeve 17 for receiving the bearing for the drive wheel D. Directly above the bearing sleeve 17 the post 14 is formed with an offset 18 so as to position a rear socket 19 with its longitudinal axis substantially aligned with the center of the bearing sleeve 17. The upper portion of the rear post 14 continues into a pusher extension 20 which has its upper end turned to form a pusher handle 21. The front post 11 and rear post 14 are structurally interconnected by an upper rail 22 located substantially at the front socket 13 and rear socket 19. It is noted that the front socket 13 is attached to the front post 11 by a body of brazed material 23, and the rear socket 19 is attached to the rear post 14 by a body of brazed material 24 together with a suitable bracket 25.

The side frame assembly is completed by joining the lower end of the caster arch member 16 and the inner end of the tubular member 15 by a rotatable sleeve 26 which supports the lower end of a cross brace 27. The sleeve 26 rotates about a support tube 28 which is placed in position by inserting the tube 28 through the open end of the tubular member 15 and passing it through the sleeve 26 so its innermost end 28A is confined in the lower end of the caster arch member 16. Securing elements 29 retain the support tube 28 in position so that the resulting structure rigidly interconnects the lower end of the caster arch member 16 and the rear post 14. A cap 15A closes the open end of member 15. It should be understood that the cross brace 27 is a functional part of the folding mechanism of the wheelchair which allows the two side frame assemblies to be pushed together when the wheelchair is to be folded or stored. The cross brace forms no part of the present invention and needs not be described further.

The wheelchair also includes a removable arm assembly 30 shown in FIG. 2 which is made up of an inverted U-shaped tube so as to form a rear leg 31 and an intermediate leg 32 of substantially the same length, and the intermediate leg 32 carries an L-shaped front leg 33 with a horizontal portion 33A that projects forwardly of the intermediate leg 32. The horizontal portion of the arm assembly carries a suitable arm rest 34, and there is mounted between the depending portions of the arm assembly a side panel 35 which guards against clothing of the occupant of the wheelchair becoming entangled in the drive wheel D. It is observed in FIG. 2 that the front leg 33 is provided with an elongated plug element 36 having a round shape to fit snugly into the open end of the tube which is the front socket 13 thereby forming an annular shoulder 37 which cooperates with the plug element 36 in the manner to be described. The rear leg 31 also carries an elongated plug element 38 which has a round shape so that it can be mounted in the open end of the tube which is the rear socket 19 so as to provide an annular shoulder 39. The respective shoulders 37 and 39 are adapted to engage on the upper ends of the respective sockets 13 and 19 so that vertical loads exerted on the arm rest 34 or on any part of the assembly 30 will be carried by these sockets into the side frame assembly 10.

An important feature of the present invention is illustrated in FIG. 3 wherein there is shown the upper rail 22 attached to the front post 11 and to the rear post 14 so as to hold these posts in fixed spaced relation adjacent the locations of the front socket 13 and the rear socket 19. Attention is first directed to the rear socket 19 which is configured as a cylinder that has been flattened to have an internal principal dimension A which is greater than the minor internal dimension B at right angles thereto. The major internal dimension A is directed substantially parallel to the upper rail 22 or more particularly substantially parallel to the plane of the side frame assembly 10. On the other hand, the minor internal dimension B is directed substantially perpendicular to the plane of side frame assembly. Now referring to the front socket 13 it is indicated that it is substantially cylindrical in which there is an internal substantially circular dimension B′ that is substantially equal to the minor internal dimension B of the rear socket 19.

When the removable arm assembly 30 of FIG. 2 is mounted in the front and rear sockets 13 and 19 respectively, the plug elements 36 and 38 have a normal dimension which fits snugly in the substantially circular front socket 13 and in the rear socket 19 so as to resist movement of the removable arm assembly 30 toward and away from the plane of the side frame assembly 10. However, the plug element 38 in the rear leg 31 of the removable arm assembly 30 is provided with a loose fit in the rear socket 19 in the direction of the plane of the side frame assembly 10. The uniqueness of this arrangement of socket and plug element dimensions and spacial relationship is such that if the axial center to center spacing of the respective plug elements 36 and 38 is equal to the spacing of the axial center alignment of the front socket 13 and rear socket 19, respectively, the plug element 36 would be precisely centered in the front socket 13 and the rear plug element 38 would be centered in the rear socket 19 so as to have a substantially equal gap or looseness at each side in the direction of the major internal dimension A.

Keeping in mind the unique characteristics in the dimension and spacial relationship of the front and rear sockets, and the plug elements on the front and rear legs on the removable arm assembly, it can be appreciated that the elongation or major internal dimension A of the rear socket 19 eliminates the need for extreme accuracy of the spacial position between the plug elements on the removable arm assembly and the sockets carried by the side frame assembly. By utilizing a close tolerance fit between the outside diameter of the plug elements and the internal dimension B and B′ of the sockets it is a unique result that the removable arm assembly 30 is substantially prevented from any side movement in a direction perpendicular to the plane of the side assembly 10. It is a unique achievement of the present invention to form the rear socket 19 with an internal major dimension A so as to insure a fit of the plug element without sacrificing the close tolerance fit in the perpendicular direction. Due to the dimensional configuration of the respective sockets 13 and 19 removable arm assembly 30 can be very nicely interchanged between arm chairs so as to achieve a universal interchangeability on various styles of arms on the same wheelchair models.

The disclosure in FIG. 3 is given with respect to the dimensional characteristics of the rear socket 19 where it is shown as an elongated oval, but it is appreciated that other configurations may be substituted for the elongated oval as long as the dimensional relationships A and B are retained. It should also be appreciate that the dimensional characteristics of the rear socket 19 can be applied to the front socket 13, and the single dimensional characteristic of the front socket 13 can be applied to the rear socket 19. However, it is found to be satisfactory from the view point of the occupant of the wheelchair to have the front socket 13 snugly receive the plug element 36 in the front of the removable arm assembly, thereby not requiring such precise positioning of the rear plug element in relation to the rear socket 19.

It should now be appreciated that changes and variations may be resorted to in view of the principles of the invention set forth in the foregoing description, and all such changes and variations are to be included within the spirit of this disclosure.

What is claimed is:

1. In a wheelchair adapted to be associated with supporting wheels and comrising a side frame assembly having front and rear axially elongated posts connected in spaced relationship by an upper rail and a lower rail, said posts and rails lying in a common plane, the improvement of:

(a) first and second socket arranged such that a socket is carried by each of said front and rear posts with both said sockets being spaced apart a predetermined distance and being positioned at the same side of the common plane, each of said sockets having an internal opening and a first one of said sockets having its internal opening elongated as measured in the direction substantially parallel with the common plane larger than its dimension at right angles thereto, and the second one of said sockets having a substantially circular shaped opening having a dimension substantially the same as the second mentioned dimension of said first socket; and (b) a removable arm assembly providing front and rear legs having ends in the form of axially elongated circular plug elements in position to enter said sockets and fit snugly in said internal openings to oppose motion in a direction perpendicular to the common plane for achieving sidewards rigidity, with one of said plug elements having a loose fit in said first one of said sockets and the other of said plug elements as measured in a direction substantially parallel with the common plane and a close tolerance fit in a direction perpendicular to said common plane, and whereby both of said sockets act on said circular plug elements of said arm assembly to resist movement of said arm assembly in a direction substantially perpendicular to said common plane.

2. The wheelchair set forth in claim 1 wherein said front and rear legs of said arm assembly are larger than said plug elements carried thereby to form a shoulder surface of a size to engage and rest upon said sockets for supporting loads exerted on said arm assembly.

3. The wheelchair set forth in claim 1 wherein each of said sockets has a lengthwise dimension with its axial center substantially parallel with the axis of the post by which it is carried, said plug elements carried by said front and rear legs are elongated in the axial direction of said posts, and the spacial dimension of the axial centers of said sockets and said plug elements are substantially the same as measured in the direction of the common plane whereby said plug element fitted in said elongated socket is substantially centered so as to leave a space on each side.

4. In a wheelchair having a side frame assembly supporting a drive wheel and a caster wheel in which the side frame assembly includes a front post and a rear post, the improvement comprising:

(a) a removable arm assembly having an elongated arm rest support provided with a rear leg and a front leg spaced apart along the length of said arm rest and lying in a common plane with said arm rest support;

(b) said front and rear legs having ends and plug elements carried by said ends of said front and rear legs of said removable arm assembly; and (c) socket means supported on the front and rear posts of said side frame assembly and presented in spaced apart relation to receive said plug elements of said arm assembly, said socket means being positioned so as to align in the common plane of said removable arm assembly, one of said socket means presenting a circular opening for one of said plug elements for providing a substantially snug fit, and the other of said socket means being flattened so as to present a non-circular opening for receiving the other one of said plug elements, said flattened socket means having a principal internal dimension directed substantially parallel to the common plane of said arm assembly in which that non-circular opening is a snug fit only in a direction perpendicular to the common plane and a loose fit in a direction parallel to the common plane of said arm assembly, said socket means acting on said plug elements to resist movement of said arm assembly in a direction perpendicular to said common plane.

* * * * *